US009267768B1

(12) United States Patent
Chang

(10) Patent No.: US 9,267,768 B1
(45) Date of Patent: Feb. 23, 2016

(54) MULTI-PURPOSE STUN GUN

(71) Applicant: Hung-Yi Chang, Taichung (TW)

(72) Inventor: Hung-Yi Chang, Taichung (TW)

( * ) Notice: Subject to any disclaimer, the term of this patent is extended or adjusted under 35 U.S.C. 154(b) by 0 days.

(21) Appl. No.: 14/456,929

(22) Filed: Aug. 11, 2014

(51) Int. Cl.
*F41H 13/00* (2006.01)

(52) U.S. Cl.
CPC ..... *F41H 13/0025* (2013.01)

(58) Field of Classification Search
CPC ..... F41H 13/0025; F41H 13/0018; F41H 13/0031; F41H 13/0087; F41H 13/0012; F41H 13/00; F41H 13/005; H05C 1/06; F42B 12/46; F42B 12/362; F42B 12/40; F42B 12/54; F42B 5/145; F42B 27/08; F42B 5/08; F42B 5/03; F42B 7/04; F41B 15/04; F41B 11/62; F41B 11/85; F41B 11/72; F41B 11/60; F41B 9/0031; F41G 3/16; F41G 3/2655; F41C 27/00; F41C 33/029; F41C 3/04; F41A 19/58; F41A 33/02; F41A 19/59; F41A 19/60; F41A 19/68; F41A 21/06; F41A 3/60; F41A 5/18
USPC ..... 42/1.08, 84; 361/232
See application file for complete search history.

(56) References Cited

U.S. PATENT DOCUMENTS 6,575,073 B2 * 6/2003 McNulty, Jr. ..... F41H 13/0025 42/84
7,631,452 B1 * 12/2009 Brundula ..... F41A 17/063 361/232
7,787,232 B2 * 8/2010 Abatemarco ..... A45B 3/04 361/232
7,900,388 B2 * 3/2011 Brundula ..... F41H 13/0018 361/232
8,356,438 B2 * 1/2013 Brundula ..... F41A 17/063 42/1.08
8,363,376 B2 * 1/2013 Abatemarco ..... A45B 3/04 361/232
2005/0024807 A1 * 2/2005 Cerovic ..... F41C 3/00 361/232
2006/0027127 A1 * 2/2006 Cerovic ..... F41H 13/0018 102/502
2006/0067026 A1 * 3/2006 Kaufman ..... H05C 1/06 361/232
2006/0187610 A1 * 8/2006 Su ..... F41H 13/0025 361/232
2007/0151551 A1 * 7/2007 Verini ..... F41B 11/721 124/74
2011/0013337 A1 * 1/2011 Brown ..... F41H 5/08 361/232
2012/0036990 A1 * 2/2012 Braun ..... F41B 11/52 89/37.01

* cited by examiner

*Primary Examiner* — Troy Chambers
*Assistant Examiner* — Bridget Cochran

(57) ABSTRACT

A multi-purpose stun gun is provided with a housing including top launchers, a sound and light interference device adjacent to the launchers, a front recess under the launchers; first triggers adjacent to the launchers respectively, a rear handle, a high-voltage generator in the handle, a battery power supply in the handle for supplying electricity to the high-voltage generator, a second trigger on the housing and electrically interconnecting the high-voltage generator and the launchers, a safety on the housing for locking the second trigger, and positive and negative electrodes on the front recess and electrically connected to both the high-voltage generator.

5 Claims, 6 Drawing Sheets

MULTI-PURPOSE STUN GUN

BACKGROUND OF THE INVENTION

1. Field of the Invention

The invention relates to electroshock weapon and more particularly to a multi-purpose stun gun capable of producing an audible alarm, emitting light, emitting flashing light, firing pellet(s), and hitting a target by transmitting high voltage electricity to the target.

2. Description of Related Art

Moral is decayed in today's society. Security is increasingly corrupt. Newspapers, magazines, and television news often report sensational murders and robberies. For the sake of self-defense, people going out alone or security guards may carry self-defense weapon for protection purpose.

Conventional defensive weapons are used for incapacitating a criminal a shortest time without causing death. For example, spray guns, alarms, and stun batons are commercially available in which the stun batons are most popular. However, a number of drawbacks are found in the stun batons. For example, a person must use the stun baton to repel an attacker by administering electric shock aimed at disrupting superficial muscle functions of the attacker. This is dangerous due to close proximity to the attacker especially a brutal attacker. Further, only one function (i.e., electroshock) is provided by the stun gun. This is not sufficient and does not meet the needs of self-defense.

Thus, the need for improvement still exists.

SUMMARY OF THE INVENTION

It is therefore one object of the invention to provide a multi-purpose stun gun comprising a housing; a plurality of launchers disposed on a top of the housing; a sound and light interference device disposed adjacent to the launchers; a front recess disposed under the launchers; a plurality of first triggers disposed adjacent to the launchers respectively; a handle formed on a rear portion of the housing; a high-voltage generator disposed in the handle; a battery power supply disposed in the handle for supplying electricity to the high-voltage generator; a second trigger disposed on the housing and electrically interconnecting the high-voltage generator and the launchers; a safety disposed on the housing for locking the second trigger; a positive electrode disposed on the front recess; and a negative electrode disposed on the front recess; wherein the high-voltage generator is electrically connected to both the positive and the negative electrodes.

The above and other objects, features and advantages of the invention will become apparent from the following detailed description taken with the accompanying drawings.

DETAILED DESCRIPTION OF THE INVENTION

Figure 1:
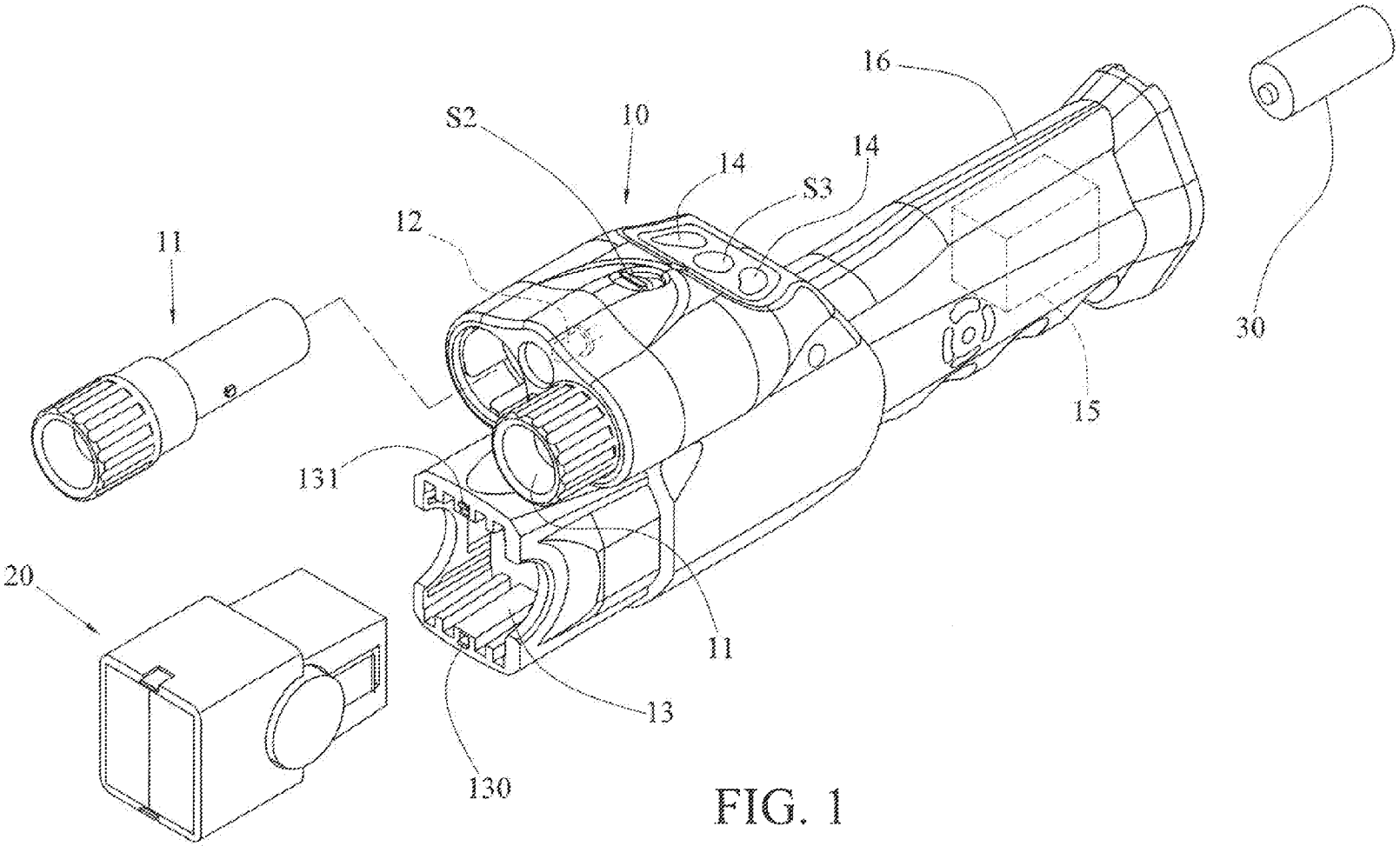
FIG. 1 is an exploded, perspective view of a multi-purpose stun gun according to the invention.
Figure 2:
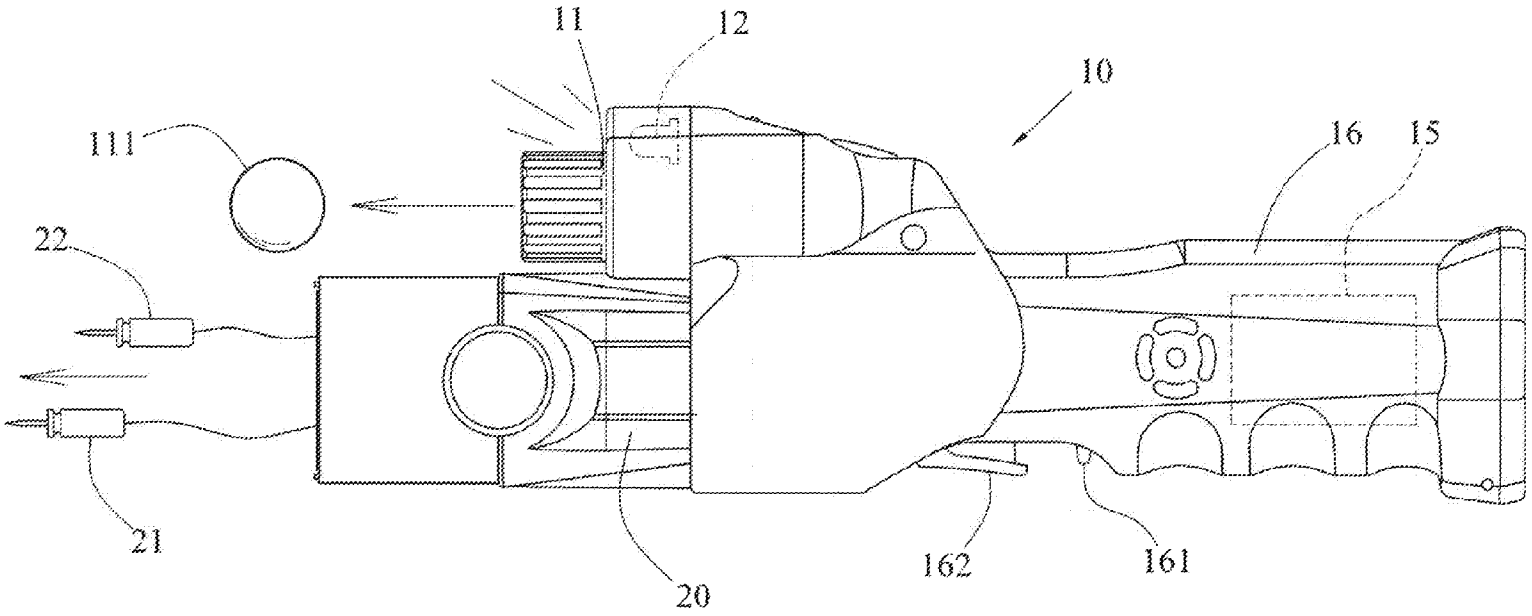
FIG. 2 is a side elevation depicting operation of the multi-purpose stun gun.
Figure 3:
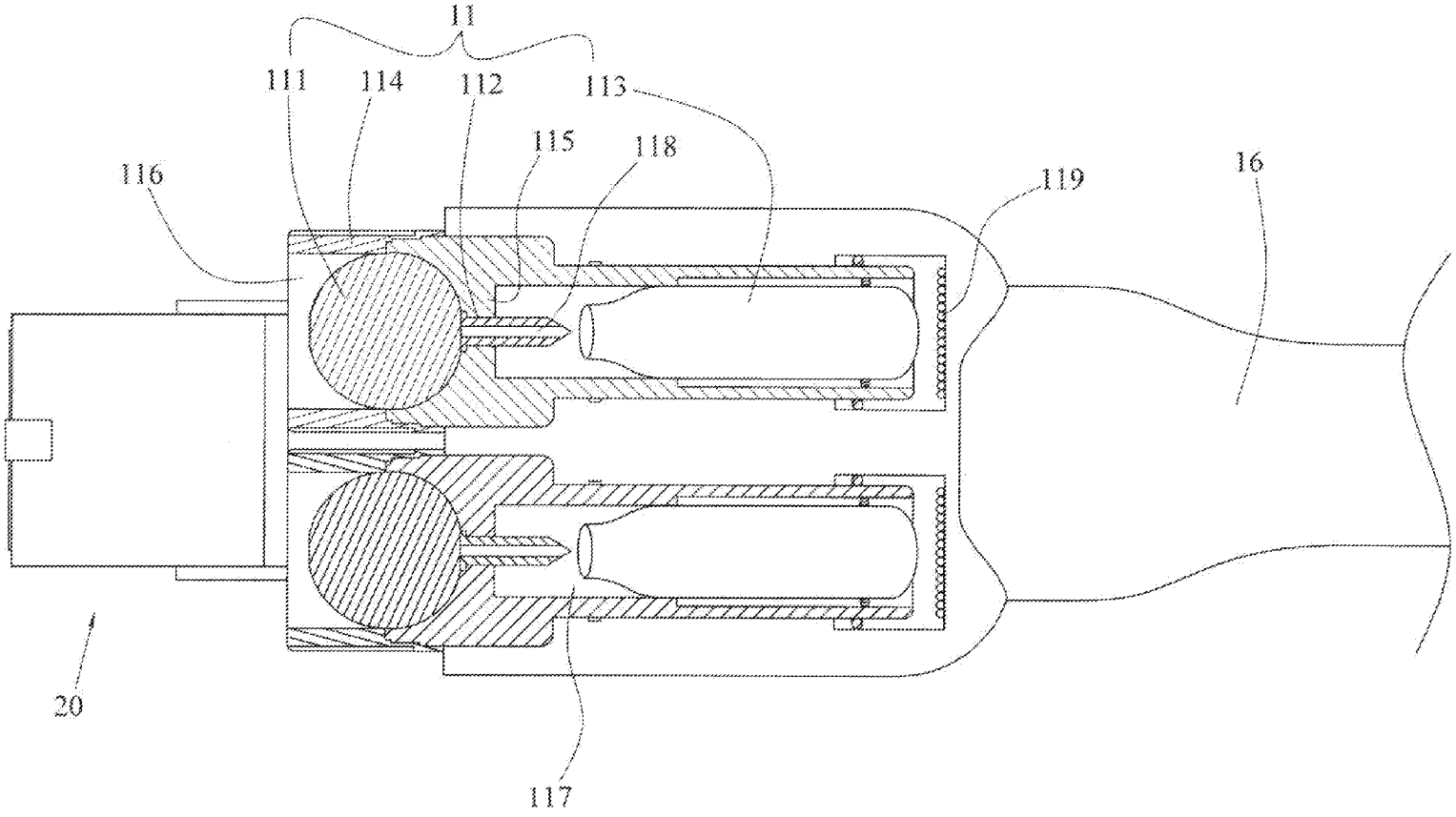
FIG. 3 is a top view in part section of the multi-purpose stun gun.

Referring to FIGS. 1 to 6, a multi-purpose stun gun in accordance with the invention comprises the following components as discussed in detail below.

A housing 10 including two cylindrical launchers 11 on a top, a sound and light interference device 12 between the launchers 11, a front recess 13 under the launchers 11, two first triggers 14 behind the launchers 11 respectively, a rear handle 16, and a high-voltage generator 15 in the handle 16. A battery 30 as power supply is in the handle 16 and is used for supplying electricity to the high-voltage generator 15 so that the high-voltage generator 15 can generate high voltage in response to activation. A second trigger 162 electrically connected to the high-voltage generator 15 for activating it or not, and a safety 161 for locking the second trigger 162 or not are provided on a bottom of the handle 16.

In each launcher 11 there are provided a hollow, cylindrical front guide 114, a front chamber 116 formed in the front guide 114 and open to the forward end, a spherical pellet 111 in the front chamber 116 and being positioned by the front guide 114, a rear chamber 117, an air canister 113 in the rear chamber 117, a divider 115 for separating the front chamber 116 from the rear chamber 117, a firing pin 112 through the divider 115 into the rear chamber 117 to be proximate to the mouth of the air canister 113, a channel 118 through the firing pin 112 for communicating the front chamber 116 with the rear chamber 117, and a propellant 119 spaced from a rear end of the rear chamber 117.

A positive electrode 130 and a negative electrode 131 are provided on a bottom and a top of the recess 13 respectively. The high-voltage generator 15 is electrically connected to the positive and the negative electrodes 130, 131 respectively via a safety switch S3 disposed adjacent to the sound and light interference device 12. A cartridge 20 is releasably disposed in the recess 13. A positive dart 21 electrically connected to the positive electrode 130, and a negative dart 22 electrically connected to the negative electrode 131 are disposed in the cartridge 20 respectively.

In a first mode of operation, a user may unlock the safety 161 and then squeeze the second trigger 162. High voltage is in turn supplied from the high-voltage generator 15 to the first triggers 14. The user may further press, for example one of the first triggers 14, so as to supply the high voltage to the propellant 119 for ignition. The ignited propellant 119 generates pressurized air to push the air canister 113 to have it mouth to be pierced by the sharp end of the firing pin 112. Pressurized air in the air canister 113 thus releases to push the pellet 111 by passing through the channel 118. As a result, the pellet 111 is fired toward a target.

In a second mode of operation, a user may unlock the safety 161 and then squeeze the second trigger 162. High voltage is in turn supplied from the high-voltage generator 15 to the safety switch S3. The user may further press the safety switch S3 to supply high voltage to the positive and the negative electrodes 130, 131 respectively. The user may hit a target (e.g., an attacker) by striking the mouth of the recess 13 on the attacker. Electricity is thus supplied to the attacker by transmitting electricity from the positive electrode 130 to the negative electrode 131 through the body of the attacker. As a result, the attacker is subdued.

In a third mode of operation, a user may unlock the safety 161 and then squeeze the second trigger 162. High voltage is in turn supplied from the high-voltage generator 15 to the safety switch S3. The user may further press the safety switch S3 to supply high voltage to the positive and the negative electrodes 130, 131 respectively. And in turn, both the positive dart 21 and the negative dart 22 are electrified. The user may hit a target (e.g., an attacker) by striking the cartridge 20 on the attacker. Electricity is thus supplied to the attacker by transmitting electricity from the positive dart 21 to the negative dart 22 through the body of the attacker. As a result, the attacker is subdued.

Figure 4:
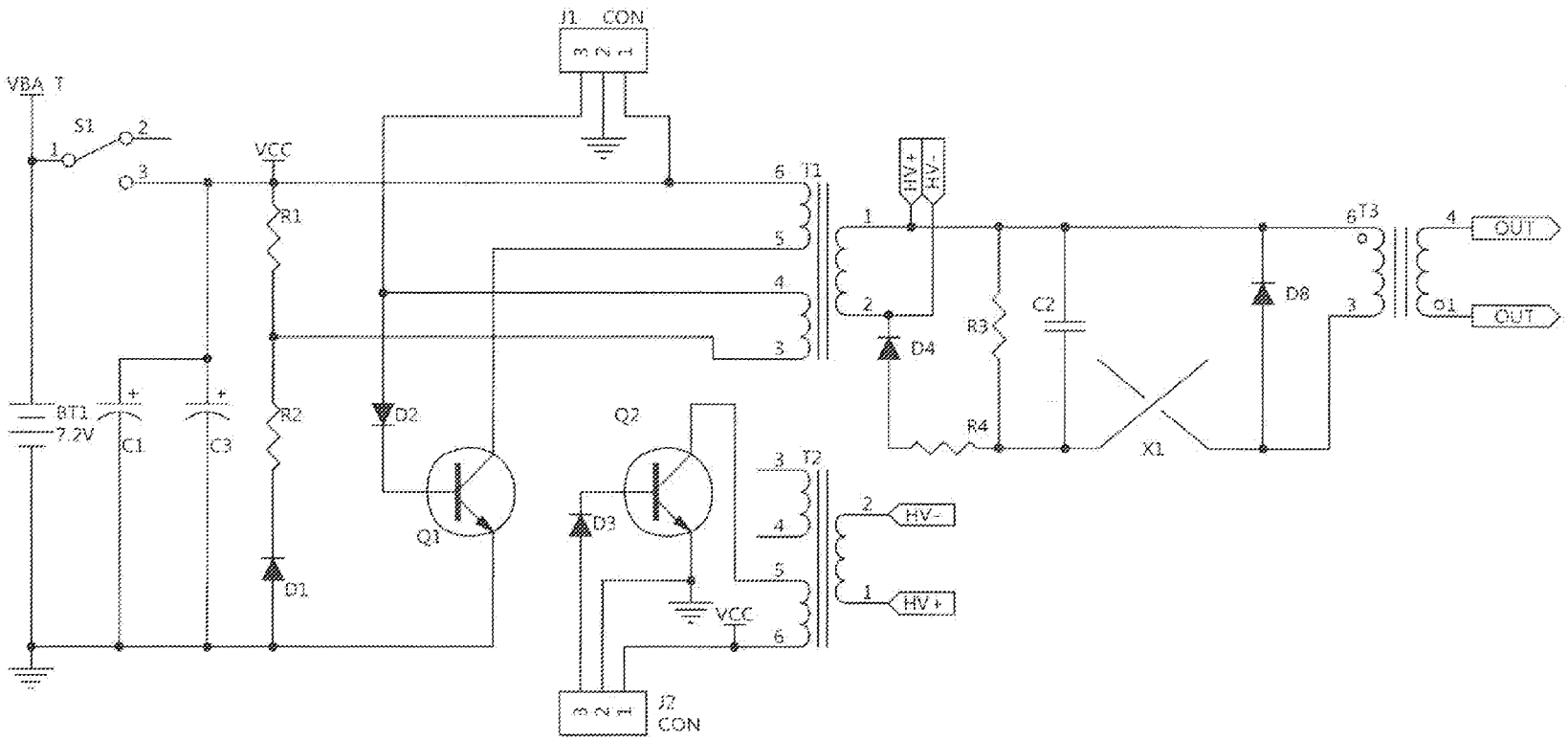
FIG. 4 is a circuit diagram of the high-voltage generator.

As shown in FIG. 4 specifically, circuitry of the high-voltage generator 15 including a self-excited oscillator T1 having a first winding 5, 6, a second winding 3, 4, and a transistor Q1. Resistors R1, R2, and a diode D1 provide a bias for triggering the transistor Q1 and adjusting output power. Oscillation voltage is increased to about 3 KV by a third winding 1, 2 of the oscillator T1. Next, it is rectified by a rectification device consisting of diode D4, resistors R3, R4, and a capacitor C2. As such, a direct current (DC) is obtained. Switch X1 will be closed when voltage between two conductors of the capacitor C2 is greater than 2 KV. As a result, voltage is further increased prior to outputting.

Figure 5:
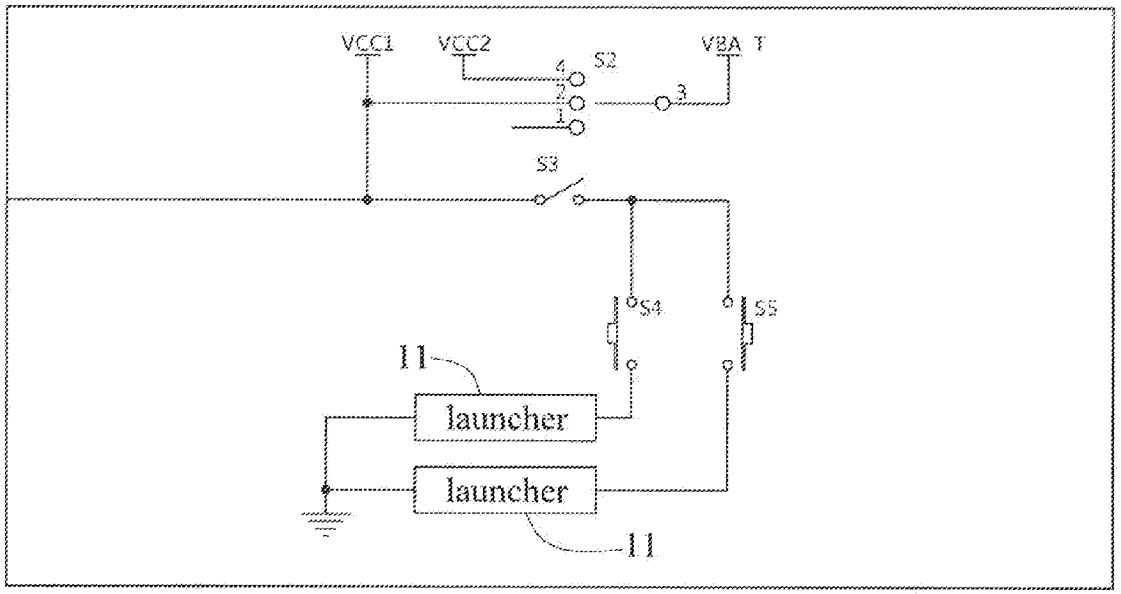
FIG. 5 is a circuit diagram of the first triggers.
Figure 6:
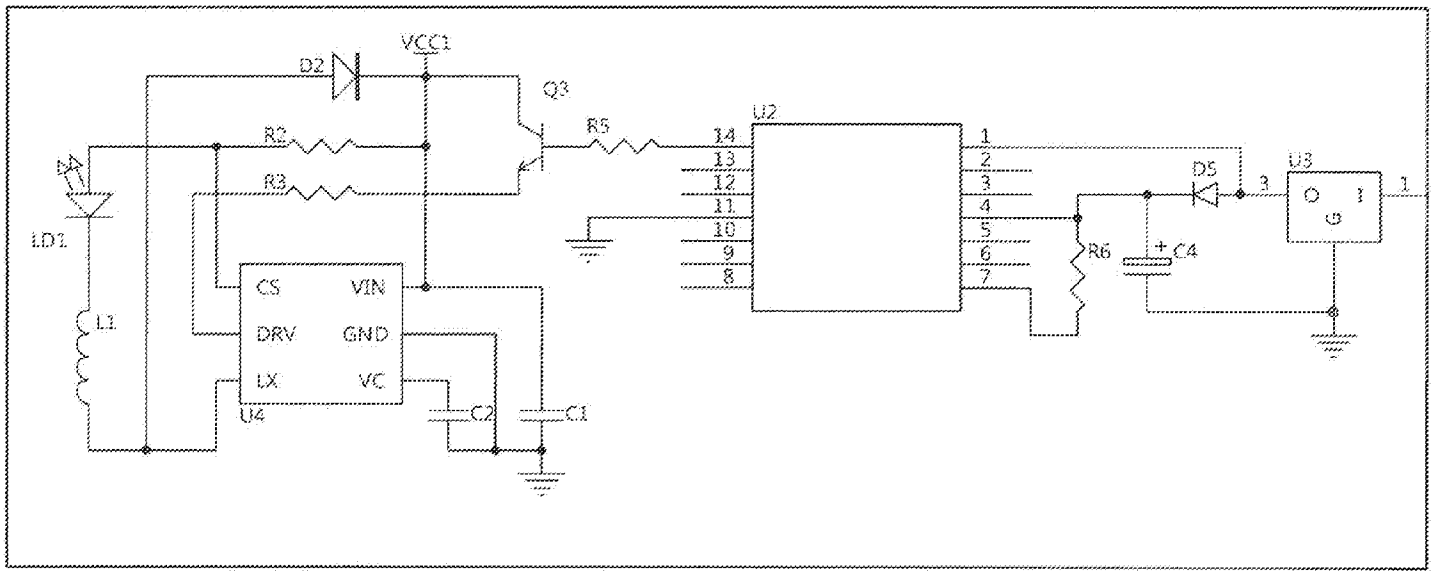
FIG. 6 is a circuit diagram of the sound and light interference device.

As shown in FIGS. 5 and 6 specifically, circuitry of the first triggers 14 and circuitry of the sound and light interference device 12 are shown. A slider switch S2 can be slid to an intermediate position to short-circuit contacts 2 and 3, thereby flashing the sound and light interference device 12. A controller U2 also outputs a voltage which is sent to a transistor Q3 via a resistor R5. The transistor Q3 is conducted to activate a white light LED IC U4. And in turn, the activated U4 activates an LED LD1 to emit flashing light which can daze an attacker as a fourth mode of operation. At the same time, electricity is supplied to a safety switch S3 to close it. And in turn, a user may close a switch S4 by pressing, close a switch S5 by pressing, or close both switches S4, S5 by pressing, thereby firing a pellet 111 out of one launcher 11, or a pellet 111 out of the other launcher 11, or two pellets 111 out of the launchers 11 at the same time. The pellet(s) 111 can hit individual(s) for achieving the purpose of non-lethal suppression of dangerous suspects.

Alternatively, the slider switch S2 can be slid to the intermediate position to short-circuit contacts 2 and 3 after sliding to the rear OFF position. And in turn, the controller U2 is activated to output a voltage which is sent to the transistor Q3 via the resistor R5. The transistor Q3 is conducted to activate the white light LED IC U4. And in turn, the activated U4 activates the LED LD1 to emit light as a function similar to flashlight.

Still alternatively, the slider switch S2 can be slid to a forward position to short-circuit contacts 3 and 4. As a result, an audible alarm is produced with both the light emitting and pellet firing functions being deactivated.

Preferably, the non-lethal pellets 111 are pellets containing pepper or plastic pellets.

Preferably, the sound and light interference device 12 is a device capable of firing a grenade for making sound and emitting light, firing a pellet for making sound and emitting light, emitting light, or emitting laser.

Preferably, firings of the launchers 11 are controlled by the first triggers 14 respectively.

Preferably, the pellet 111 can be fired only after pressing the safety switch S3 and pressing one of the first triggers 14 sequentially as a means of safety.

While the invention has been described in terms of preferred embodiments, those skilled in the art will recognize that the invention can be practiced with modifications within the spirit and scope of the appended claims.

What is claimed is:

1. A multi-purpose stun gun comprising: a housing; a plurality of launchers disposed on a top of the housing; a sound and light interference device disposed adjacent to the launchers; a front recess disposed under the launchers; a plurality of first triggers disposed adjacent to the launchers respectively; a handle formed on a rear portion of the housing; a high-voltage generator disposed in the handle; a battery power supply disposed in the handle for supplying electricity to the high-voltage generator; a second trigger disposed on the housing and electrically interconnecting the high-voltage generator and the launchers; a safety disposed on the housing for locking the second trigger; a positive electrode disposed on the front recess; and a negative electrode disposed on the front recess; wherein the high-voltage generator is electrically connected to both the positive and the negative electrodes; wherein each of the launchers including a hollow front guide, a front chamber formed in the front guide and open to a forward end, a pellet in the front chamber and being positioned by the front guide, a rear chamber, an air canister disposed in the rear chamber, a divider for separating the front chamber from the rear chamber, a firing pin disposed through the divider into the rear chamber to be proximate to the air canister, a channel formed through the firing pin for communicating the front chamber with the rear chamber, and a propellant spaced from a rear end of the rear chamber.

2. The multi-purpose stun gun of claim 1, further comprising a safety switch disposed adjacent to the sound and light interference device, the safety switch being configured to control an activation of one of the launchers or both.

3. The multi-purpose stun gun of claim 1, further comprising a cartridge releasably disposed in the recess, the cartridge including a positive dart electrically connected to the positive electrode, and a negative dart electrically connected to the negative electrode.

4. The multi-purpose stun gun of claim 1, wherein the sound and light interference device is capable of firing a grenade for making sound and emitting light, firing a pellet for making sound and emitting light, emitting light, or emitting laser.

5. The multi-purpose stun gun of claim 1, wherein the pellet comprises either a plastic or pepper pellet.

* * * * *